US008425760B2

(12) United States Patent
Lenglet et al.

(10) Patent No.: US 8,425,760 B2
(45) Date of Patent: Apr. 23, 2013

(54) PROCESS FOR CONVERTING GAS INTO LIQUIDS WITH SIMPLIFIED LOGISTICS

(75) Inventors: Eric Lenglet, Rueil-Malmaison (FR); Patrick Chaumette, Rueil-Malmaison (FR)

(73) Assignee: IFP Energies Nouvelles, Reuil-Malmaison Cedex (FR)

( * ) Notice: Subject to any disclaimer, the term of this patent is extended or adjusted under 35 U.S.C. 154(b) by 594 days.

(21) Appl. No.: 12/516,505

(22) PCT Filed: Nov. 12, 2007

(86) PCT No.: PCT/FR2007/001861

§ 371 (c)(1),
(2), (4) Date: Jul. 7, 2010

(87) PCT Pub. No.: WO2008/065284

PCT Pub. Date: Jun. 5, 2008

(65) Prior Publication Data

US 2010/0276334 A1 Nov. 4, 2010

(30) Foreign Application Priority Data

Nov. 27, 2006 (FR) ..... 06 10497

(51) Int. Cl.
*H01B 3/22* (2006.01)

(52) U.S. Cl.
USPC ..... 208/14; 208/108; 208/109; 208/110; 208/112; 208/134; 208/137; 208/138

(58) Field of Classification Search ..... 208/14, 208/108–112, 134, 137–138
See application file for complete search history.

(56) References Cited

U.S. PATENT DOCUMENTS

| | | | |
|---|---|---|---|
| 4,832,819 | A | 5/1989 | Hamner |
| 5,378,348 | A | 1/1995 | Davis et al. |
| 5,689,031 | A | 11/1997 | Berlowitz et al. |

(Continued)

FOREIGN PATENT DOCUMENTS

| | | | |
|---|---|---|---|
| EP | 0 321 305 | A2 | 10/2001 |
| WO | WO 97/14768 | | 4/1997 |
| WO | WO 02/077128 | A | 10/2002 |

OTHER PUBLICATIONS

International Search Report, date of mailing Sep. 17, 2008, Authorized Officer Patricia Deurinck, pp. 4, International Application No. PCT/FR2007/001861.

*Primary Examiner* — Brian McCaig
(74) *Attorney, Agent, or Firm* — Millen, White, Zelano & Branigan, P.C.

(57) ABSTRACT

The invention concerns a process for converting a stream of natural or associated gas into liquid fractions, comprising:

a) a step for converting said stream of gas into a synthesis gas SG;

b) a step FT for Fischer-Tropsch synthesis to convert the SG into liquid fractions;

c) a step for fractionating the effluents from the Fischer-Tropsch synthesis into at least one relatively heavy fraction comprising waxes with a boiling point of 565° C. or more and at least one relatively light fraction;

d) a step HCKI for isomerization hydrocracking of the relatively heavy fraction, in which at least 75% by weight of the fraction of the feed with a boiling point of more than 565° C. is converted into compounds boiling below 565° C.;

e) at least one step for mixing at least the effluents from step HCKI (step d)), the light fraction from step c) and a crude oil P, to thereby produce an oil P*.

9 Claims, 1 Drawing Sheet

U.S. PATENT DOCUMENTS

| | | | | |
|---|---|---|---|---|
| 6,310,108 | B1 | 10/2001 | Bonneau et al. | |
| 6,822,131 | B1 | 11/2004 | Berlowitz et al. | |
| 2002/0144929 | A1 | 10/2002 | Moore et al. | |
| 2002/0169219 | A1 | 11/2002 | Moore et al. | |
| 2002/0170228 | A1 | 11/2002 | Davis et al. | |
| 2007/0135664 | A1 * | 6/2007 | Ansell et al. | 585/13 |

* cited by examiner

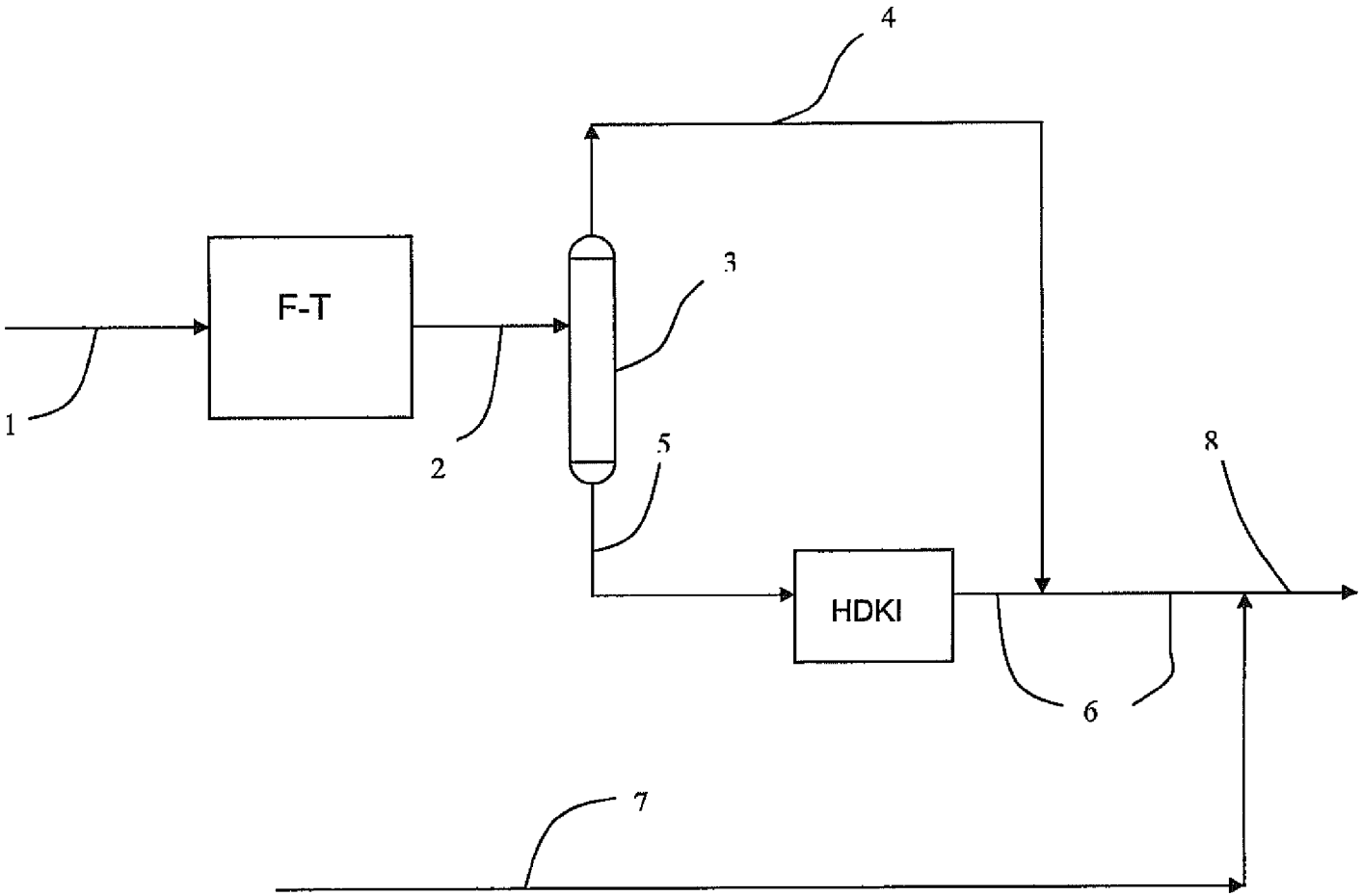
F-T
HDKI
1
2
3
4
5
6
7
8

PROCESS FOR CONVERTING GAS INTO LIQUIDS WITH SIMPLIFIED LOGISTICS

FIELD OF THE INVENTION

The present invention relates to the natural gas industry or the industry of gas associated with oil, and in particular oil and gas treatment in the production region of both oil and gas.

It also and more particularly relates to the chemical conversion of natural gas into transportable liquid hydrocarbon fractions by the Fischer-Tropsch process.

PRIOR ART

The conversion of gas into transportable liquid fractions is an important objective in many gas production regions. Transforming gas, natural and/or associated, into liquid hydrocarbons by the Fischer-Tropsch process is already known. This option is important when it is difficult to upgrade gas, for example for gas production fields which are isolated or far from pipeline transportation infrastructures or from a gas liquefaction factory.

The first step in transforming natural or associated gas corresponds to producing synthesis gas, a mixture of hydrogen ($H_2$) and carbon monoxide (CO). Many processes for producing synthesis gas are known, such as steam cracking, partial oxidation or the autothermal process. Reference may in particular be made to the reference work "Le raffinage du pétrole, procédés de transformation" [Oil refining: transformation processes] by P Leprince, Technip, Paris, pages 467 to 509.

The Fischer-Tropsch synthesis step may be carried out in a variety of manners using any known reactors and processes using any known catalyst, in particular based on iron or cobalt. It is typically carried out with a catalyst which is suitable for the $H_2$/CO ratio of the synthesis gas produced. As an example, it is typically possible to use a cobalt catalyst for a synthesis gas with a $H_2$/CO molar ratio in the range from about 1.8 to 2.5, or an iron catalyst for a synthesis gas with a $H_2$/CO molar ratio in the range from about 1.2 to 2, for example, these values not being limiting in nature.

Regarding the Fischer-Tropsch reactor, a three-phase fixed bed reactor or "slurry" reactor may be used, i.e. a three-phase reactor with a liquid phase comprising a divided solid catalyst in suspension and a gas phase (in this case synthesis gas, a mixture principally composed of hydrogen and carbon monoxide). The Fischer-Tropsch catalyst may be used in the form of fine particles in suspension comprising an inert support impregnated with iron or cobalt. As an example, a support based on alumina or silica or zirconia or silica-alumina or alumina-zirconia may be used, impregnated with 10% to 40% by weight of iron or cobalt with respect to the overall catalyst. The three-phase mixture may generally comprise particles of catalyst with a mean diameter in the range 3 to 150 micrometers, preferably 10 to 120 micrometers, in suspension in a liquid essentially composed of reaction products, in particular paraffin waxes which are molten at the reaction temperature. The percentage by weight of catalyst may generally be between 10% and 40% by weight of catalyst with respect to the weight of the liquid suspension comprising the solid catalyst. The surface velocity of the gas in the treatment may be in the range 0.05 m/s to 0.4 m/s, preferably in the range 0.12 to 0.3 m/s. The pressure is usually in the range 1.5 to 4 MPa, preferably in the range 1.8 to 2.8 MPa. The temperature is usually in the range 215° C. to 255° C., preferably in the range 230° C. to 240° C. Further details concerning Fischer-Tropsch catalysts and/or processes may be obtained from the following patents or patent applications: EP-A-0 450 860, U.S. Pat. Nos. 5,961,933, 6,060,524, 6,921,778 and WO-A-2006/067285.

The Fischer-Tropsch synthesis can transform the major portion of the synthesis gas into liquid fractions.

Typically, the Fischer-Tropsch effluents are treated to convert them into finished commercial products: liquefied petroleum gas, naphtha, kerosene, gas oil. To this end, in addition to the fractionation which is required, typically isomerization hydrocracking, HCKI, of the waxes (long chain paraffins which are solid at ambient temperature) is carried out, often along with fractions boiling above 150° C. to 200° C., the lightest fractions being hydroisomerized and not cracked.

The isomerization hydrocracking step HCKI, occasionally termed hydroisomerization, is known in the art.

EP-A-0 583 836 describes a process for producing middle distillates from the feed obtained by Fischer-Tropsch synthesis. In that process, the feed is treated in its entirety. In addition, it is possible to remove the $C_4$-fraction (fraction comprising compounds with 4 or fewer carbon atoms) and obtain the treated $C_5$+ fraction (fraction comprising compounds containing 5 or more carbon atoms). This feed undergoes hydrotreatment then hydroisomerization with a conversion (of products boiling above 370° C. into products with a lower boiling point) of at least 40% by weight. One of the catalysts which are suitable for hydroconversion consists of a platinum on silica-alumina formulation. The conversions described in the examples are at most 60% by weight.

EP-A-0 321 303 also describes a process for treatment of said feeds to produce middle distillates and possibly oils. In one particular implementation, the middle distillates are obtained using a process consisting of treating the heavy fraction of the feed, i.e. with an initial boiling point in the range 232° C. to 343° C., by hydroisomerization on a fluorine-containing catalyst containing a group VIII metal and alumina and having particular physico-chemical characteristics. After hydroisomerization, the effluent is distilled and the heavy portion is recycled to the hydroisomerization step. The hydroisomerization conversion of 370° C.+ products is given as being in the range 50-95% by weight and the examples testify to 85-87%.

Reference may also be made to European patent application EP-A-1 590 424 which describes another isomerization hydrocracking process and a suitable catalyst.

The catalysts which are currently used in isomerization hydrocracking are of the bifunctional type, combining an acidic function and a hydrogenating function. The acid function is typically supplied by supports with large surface areas (150 to 800 $m^2$/g in general) with a superficial acidity, such as halogenated aluminas (mainly chlorine-containing or fluorine-containing), phosphorus-containing aluminas, combinations of boron oxides and aluminium, amorphous silica-aluminas and silica-aluminas. The hydrogenating function is provided either by one or more metals from group VIII of the periodic table, such as iron, cobalt, nickel, ruthenium, rhodium, palladium, osmium, iridium or platinum, or by an association of at least one group VI metal such as chromium, molybdenum or tungsten and at least one group VIII metal.

The equilibrium between the two functions, acid and hydrogenating, is one of the parameters which govern the activity and selectivity of the catalyst. A weak acid function and a strong hydrogenating function produce low activity catalysts which are selective as regards isomerization while a strong acid function and a weak hydrogenating function produce highly active catalysts which are selective as regards cracking. A third possibility is to use a strong acid function and a strong hydrogenating function to obtain a highly active catalyst which is also highly selective as regards isomerization. Thus, by carefully selecting each of the functions, it is possible to adjust the activity/selectivity balance of the catalyst.

One disadvantage of the conventional Fischer-Tropsch process is that its logistics are relatively complex when upgrading and commercializing the products obtained.

SUMMARY OF THE INVENTION

The invention proposes a process for conversion of gas into liquid products, typically in an oil production region using simple logistics which nevertheless can result in substantial upgrading of products from the Fischer-Tropsch process.

The invention is not bound to a particular mode for carrying out the Fischer-Tropsch synthesis, neither from the viewpoint of the technology of the reactor or reactors, nor from the viewpoint of the catalyst, nor from the viewpoint of the operating conditions.

According to the invention, an isomerization hydrocracking step HCKI is carried out on a heavy fraction of Fischer-Tropsch effluents then the effluents from the HCKI step are mixed with a light Fischer-Tropsch effluent fraction and a crude oil P. This atypical mixing of very high purity products contained in the HCKI effluents and crude oil can result in substantial pricing increase of the Fischer-Tropsch effluents without necessitating specific logistics for the refined products.

DETAILED DESCRIPTION OF THE INVENTION

In its most general form, the invention presents a process for transforming at least one stream of natural or associated gas into transportable liquid fractions, comprising:

a) at least one step for converting said gas stream into a synthesis gas SG comprising hydrogen and carbon monoxide;

b) a step FT for Fischer-Tropsch synthesis to convert at least the majority of the SG into liquid fractions;

c) a step for fractionating the effluents from the Fischer-Tropsch synthesis into at least one relatively heavy fraction comprising waxes with a boiling point of more than 565° C. and at least one relatively light fraction, wherein the compounds have a boiling point of less than 450° C., preferably less than 360° C., more preferably less than 260° C.;

d) a step HCKI for isomerization hydrocracking of the relatively heavy fraction, in which at least 75% by weight of the fraction of the feed with a boiling point of more than 565° C. is converted into compounds boiling below 565° C.;

e) at least one step for mixing at least:

at least the majority of the effluents from the HCKI step;

said relatively light fraction from step c), which is not transformed by isomerization hydrocracking;

a crude oil P and/or at least one fraction from treatment of crude oil;

to thereby produce an oil P*.

The quantity of fractions from FT conversion (directly and indirectly after the step HCKI) which is incorporated into the oil P* is variable. It is usually in the range 5% to 30% by weight, preferably in the range 8% to 25% by weight in P*.

Mixing not raw non-transformed Fischer-Tropsch effluents but, in contrast, isomerization hydrocracking effluents with crude oil is surprising as it produces a mixture of very high purity products and a non-refined upgraded product that has a much lower value. However, in accordance with the invention, it can transform the major portion of the Fischer-Tropsch waxes into compounds with a relatively moderate boiling point, preferably below 565° C.

This procures two technical effects: firstly, during downstream treatment of the modified oil P* in the refinery, it can increase the value of most of the Fischer-Tropsch compounds without finding them in the vacuum residue typically boiling above 565° C. Further, it reduces the pour point of the modified oil P* compared with a situation in which the direct effluents from the Fischer-Tropsch step would be diluted in a crude oil.

Preferably, the oil P* has a pour point which is reduced by at least 10° C. with respect to that of an oil P* which would be constituted by a mixture of P and the effluent from the FT step. The process of the invention may in particular be carried out with any oil P, preferably an oil P which is fluid at ambient temperature and even at 0° C. or below.

Preferably, conversion of the feed for the isomerization hydrocracking step HCKI to compounds boiling below 565° C. is adapted so that the oil P* has a pour point which is identical to or less than that of P. Improved conversion and the correlative production of a lower pour point may be achieved by adjusting the severity of the HCKI step; this is readily carried out by the skilled person, by reducing the hourly space velocity HSV and/or increasing the operating temperature and/or increasing the operating pressure.

Typically, during the HCKI step at least 85% by weight, usually 85% to 97% by weight of the fraction of the feed with a boiling point of more than 565° C. is converted into compounds boiling below 565° C.

It is also advantageous to convert between 10% and 40% by weight of this fraction (waxes) with a high boiling point of more than 565° C. into compounds boiling between 360° C. and 565° C. instead of converting all of the feed into gas oil and middle distillates. This can produce a simple isomerization hydrocracking with moderate operating conditions. The remaining compounds, boiling between 360° C. and 565° C., are then upgraded in a satisfactory manner at the refinery. These compounds are recovered then transformed principally into fuels as they constitute a satisfactory feed for catalytic cracking.

Typically, then, the isomerization hydrocracking step HCKI can be carried out in a single pass (no recycling), which is a major advantage. Further, the HCKI effluents may then be incorporated into the modified oil P* without prior fractionation.

The logistics of evacuating the Fischer-Tropsch products is also particularly simple with the process of the invention, as we benefit from existing logistics for the oil P.

According to the invention, the word "oil", and in particular "oil P or P* " can be understood as a feedstock of an atmospheric distillation unit in an oil refinery. An oil thus comprise typically at least 4% by weight, and generally at least 6% by weight of each of the following cuts that are defined by their ASTM distillation ranges or domains:

naphtha [30° C.-220° C];

middle distillates ]220° C.-360° C];

vacuum distillate ]360° C.-565° C];

vacuum resid 565° C.+ (compounds boiling above 565° C].

The invention will be better understood from the following description of FIG. 1 which shows a non-limiting example of a flowchart for a facility for carrying out the process of the invention in accordance with a preferred implementation.

DESCRIPTION OF FIG. 1

After purification, a natural or associated gas is transformed into synthesis gas (by means which are not shown, for example by the autothermal process); said synthesis gas feeds via line 1 the Fischer-Tropsch synthesis reaction section (FT). The synthesis gas may typically have a $H_2$/CO molar ratio of 2.1 and supply the Fischer-Tropsch slurry reactors functioning with a cobalt on alumina catalyst.

At the outlet from the Fischer-Tropsch reaction section (FT), the crude effluent moving in line 2 is fractionated by distillation in column 3 into a relatively light fraction (principally short naphtha) with a boiling point of less than 160° C., evacuated via a line 4, and a relatively heavy fraction with a boiling point of more than 160° C. which includes waxes with a boiling point of more than 565° C. A small quantity of liquefied petroleum gas (LPG) is also evacuated via a line which is not shown.

The relatively heavy fraction leaves the column 3 via a line 5 and undergoes isomerization hydrocracking (HCKI) with a conversion of 95% by weight of waxes boiling above 565° C. into products with a boiling point of less than 565° C. As an example, a catalyst and the operating conditions described in EP-A-0 321 303 may be used.

The effluents from isomerization hydrocracking (HCKI) moving in line 6 are mixed with the relatively light fraction moving in line 4 and are then incorporated in an amount of 10% by weight into a crude oil P moving in line 7, to form a modified oil P* evacuated via line 8.

Said modified oil P* has a pour point which is not substantially different from that of P because of the conversion of the heavy Fischer-Tropsch waxes in the HCKI step. The Fischer-Tropsch products contained in P* will thus be substantially upgraded during final refining of P* (they will essentially not be included in a vacuum residue but in the fractions transformed into fuels).

The logistics of evacuating the Fischer-Tropsch products is also particularly simple using the process of the invention as the logistics of the oil P are employed to advantage.

The invention claimed is:

1. A process for transforming at least one gas stream of natural gas or associated gas associated with oil production into transportable liquid fractions, comprising:

a) at least one step comprising converting said gas stream into a synthetic gas SG comprising hydrogen and carbon monoxide;

b) a step FT comprising Fischer-Tropsch synthesis to convert a least the majority of the SG into Fischer-Tropsch synthesis effluents;

c) a step comprising fractionating the effluents from the Fischer-Tropsch synthesis into at least one heavy fraction comprising waxes with a boiling point of more than 565° C. and at least one light fraction, the compounds of which have a boiling point of less than 450° C.;

d) a step HCK1 comprising isomerization hydrocracking of a feed of the heavy fraction, in which at least 75% by weight of the fraction of the feed with a boiling point of more than 565° C. is converted into compounds boiling below 565° C.;

e) at least one step comprising mixing at least:

at least the majority of the effluents from the HCK1 step;

said light fraction from step c);

a crude oil P;

to thereby produce an oil P*.

2. A process according to claim 1, in which during the HCKI step (step d), at least 85% by weight of the fraction of the feed with a boiling point of more than 565° C. is converted into compounds boiling below 565° C.

3. A process according to claim 2, in which during the HCKI step (step d), between 85% and 97% by weight of the fraction of the feed with a boiling point of more than 565° C. is converted into compounds boiling below 565° C.

4. A process according to claim 1, in which during the HCKI step (step d)), between 15% and 40% by weight of the fraction of the feed with a boiling point of more than 565° C. is converted into compounds boiling between 360° C. and 565° C.

5. A process according to claim 1, in which the HCKI step for isomerization hydrocracking is carried out in a single pass.

6. A process according to claim 1, in which the compounds in said light fraction have a boiling point of less than 260° C.

7. A process according to claim 1, in which the cumulative quantity of fractions from FT conversion which are incorporated into the oil P* is in the range of 5% to 30% by weight of said oil P*.

8. A process according to claim 1, in which each of oils P and P* comprise at least 4% by weight of each of the following cuts that are defined by their ASTM distillation ranges or domains:

naphtha [30° C.-220° C.];

middle distillates ]220° C.-360° C.];

vacuum distillate ]360° C.-565° C.];

vacuum resid 565° C.+.

9. An oil mixture comprising (a) effluents from a step of an isomerization hydrocracking at least one heavy fraction from a Fischer Tropsch synthesis with a boiling point above 565° C., (b) a light fraction from a Fischer Tropsch synthesis boiling less than 450° C., and (c) a crude oil.

* * * * *

UNITED STATES PATENT AND TRADEMARK OFFICE

CERTIFICATE OF CORRECTION

PATENT NO. : 8,425,760 B2
APPLICATION NO. : 12/516505
DATED : April 23, 2013
INVENTOR(S) : Lenglet et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1002 days.

Signed and Sealed this
Eighth Day of September, 2015

Michelle K. Lee

Michelle K. Lee
*Director of the United States Patent and Trademark Office*